US006751950B2

(12) United States Patent
Ikemoto et al.

(10) Patent No.: US 6,751,950 B2
(45) Date of Patent: Jun. 22, 2004

(54) EMISSION CONTROL APPARATUS FOR ENGINE

(75) Inventors: Noriaki Ikemoto, Kariya (JP); Hisashi Iida, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/372,264

(22) Filed: Feb. 25, 2003

(65) Prior Publication Data

US 2003/0159434 A1 Aug. 28, 2003

(30) Foreign Application Priority Data

Feb. 25, 2002 (JP) ..... 2002-047908

(51) Int. Cl.[7] ..... F01N 3/00
(52) U.S. Cl. ..... 60/285
(58) Field of Search ..... 60/274, 285

(56) References Cited

U.S. PATENT DOCUMENTS 4,452,212 A * 6/1984 Takase ..... 123/493
5,020,495 A 6/1991 Plapp
5,724,940 A * 3/1998 Hoffmann et al. ..... 123/325
6,594,988 B2 * 7/2003 Takubo et al. ..... 60/285
6,622,478 B2 * 9/2003 Nakamura ..... 60/285
6,634,168 B1 * 10/2003 Yamamoto ..... 60/285

FOREIGN PATENT DOCUMENTS

JP 8-193537 7/1996

* cited by examiner

*Primary Examiner*—Thomas E. Denion
(74) *Attorney, Agent, or Firm*—Nixon & Vanderhye P.C.

(57) ABSTRACT

An occluded oxygen quantity in a catalyst is estimated when fuel cut is executed. Then, upon return from the fuel cut, a target air-fuel ratio is set to significantly richer value. When it is detected on the basis of an output of an oxygen sensor that oxygen occluded by an upstream-side catalyst has been consumed, the target air-fuel ratio is switched to slightly richer value. Lastly, when the occluded oxygen quantity has become 0, a return is made to a normal air-fuel ratio feedback control. It is possible to consume the oxygen occluded by the catalyst quickly, and simultaneously it is possible to diminish emission released to the atmosphere even if an estimated value of the occluded oxygen quantity is deviated from an actual value.

10 Claims, 7 Drawing Sheets

START
S501
XFC=0?
NO
YES
S503
COMPUTE TP
NO
S504
XFB=1?
S502
TAU=0
YES
S506
XE1RICH=1?
NO
S508
XE2RICH=1?
NO
S505
FAF=1.0
YES
S507
YES
S509
S510
λTG=0.990
λTG=0.995
λTG=1.0
COMPUTE FAF
S511
COMPUTE FALL
S512
TAU=TP×FAF×FALL+TV
S513
END

START
S701
NO
XE2RICH=0→
XE2RICH=1?
YES
S702
SMO2-MAX-G←
SMO2-MAX-G+1/8×(SMO2-MAX−(1+1.5)×ΣPGO2-1)
SMO2←ΣPGO2-1×1.5
S703
END

START
S601
XFC=1?
NO
YES
S602
SMO2-FC←
KSMO2-FC × (GA × T)
S603
PGO2-1←0
S604
PGO2-2←0
S610
SMO2-FC←0
S611
XE1RICH=1?
NO
YES
S612
PGO2-1←
KPGO2-1 × (GA × T)
S613
COMPUTE Σ PGO2-1
S614
PRG2-1←0
S615
XE2RICH=1?
NO
YES
S616
PRG2-2←
KPGO2-2 × (GA × T)
S617
PGO2-2←0
S618
Σ PGO2-1←0
SMO2←0
S605
SMO2←SMO2+SMO2-FC+PGO2-1+PGO2-2
S606
SMO2-MAX←SMO2-MAX-G
S607
SMO2 > SMO2-MAX?
YES
NO
S608
SMO2=SMO2-MAX
END

NE
0
1000rpm

IDLE SW
1
0

λ
1.0

XE1RICH
1
0

XE2RICH
1
0

XFC
1
0

XFB
1
0

CDFC
CK1
0

CDFB
CK2
0

λ TG
1.0
0.995
0.990

FAF
1.0

VOX2
1.0
0.5
0
KOSC

SMO2
0

Σ PGO2-1
0

SMO2-MAX-G
T1 T2
T3 T4
T5
T6

EMISSION CONTROL APPARATUS FOR ENGINE

CROSS REFERENCE TO RELATED APPLICATIONS

This application is based on Japanese Patent Application No. 2002-47908 filed on Feb. 25, 2002, contents of which are incorporated herein by reference.

BACKGROUND OF THE INVENTION

1. Field of the Invention

The present invention relates to an emission control apparatus for engine, specifically to an air-fuel ratio control after a lean air-fuel ratio has continued longer than a predetermined period, especially resuming from a fuel cut operation.

2. Description of Related Art

Heretofore there has been known a technique wherein when an accelerator pedal is released by a driver during operation of an internal combustion engine, a fuel injection control is stopped or significantly decreased to reduce the amount of fuel consumed on condition that the engine speed is higher than a predetermined engine speed. This kind of control is hereinafter referred to as a fuel cut operation or fuel cut. It is generally known that if fuel cut is performed during operation of an internal combustion engine, the amount of oxygen capable of being occluded by a catalyst, e.g., a three-way catalyst, reaches saturation, the catalyst being provided in an exhaust passage of the internal combustion engine for the purification of exhaust gas.

A purification rate of a three-way catalyst indicates a maximum exhaust gas purifying characteristic in the vicinity of a stoichiometric air-fuel ratio. Therefore, there arises an inconvenience such that, even if fuel is fed so as to give a stoichiometric air-fuel ratio after the return from fuel cut, an air-fuel ratio after passing through the three-way catalyst becomes lean with oxygen occluded by the same catalyst.

As techniques for eliminating such an inconvenience there have been proposed a technique disclosed in Japanese Patent No. 2604840 and a technique disclosed in JP-A-8-193537. These techniques employ a system configuration comprising a catalytic converter disposed in an exhaust passage of an engine and a sensor, e.g., an oxygen sensor, disposed downstream of the catalytic converter to detect an oxygen concentration of exhaust gas discharged from an engine.

According to the technique disclosed in Japanese Patent No. 264840, the amount of fuel injected by an injector is increased, or enriched, by a preset amount for prompt consumption of oxygen which has been occluded by the catalytic converter after the return from fuel cut. When the output of the oxygen sensor disposed downstream of the catalytic converter has become rich, the increase, or enriching, of the amount of fuel injected is stopped assuming that the oxygen occluded by the catalytic converter has been consumed.

The system configuration according to the technique disclosed in the JP-A-8-193537 is further provided with a linear A/F sensor for detecting an air-fuel ratio of exhaust gas, the linear A/F sensor being positioned in front of the catalytic converter disposed on the engine side. In such a system, for the consumption of oxygen occluded by the catalyst after the return from fuel cut, the amount of fuel injected by the injector is increased so that an output value of the linear A/F sensor becomes a desired value. According to the technique in question, first in fuel cut, the amount of oxygen occluded by the catalytic converter is estimated. Hereinafter, the amount of oxygen occluded is referred to as an occluded oxygen quantity. Then, at the time of increasing the amount of fuel injected after the return from fuel cut, there is calculated a deoccluded oxygen quantity based on enriching of the air-fuel ratio relative to the estimated occluded oxygen quantity, and the increase of the injected fuel quantity is stopped when the occluded oxygen quantity has reached a level not requiring any further consumption of oxygen.

In the above system configuration, the number of the catalytic converter disposed in the engine exhaust passage is one. But recently, for the purpose of diminishing the emission when an engine is started in the cold, it has been known that a catalytic converter smaller in capacity than the conventional catalytic converter which permits quick warm-up of catalyst is disposed upstream of the exhaust passage. That is, there has been known a system which is provided in the engine exhaust gas passage with a linear A/F sensor, an upstream-side catalyst small in capacity, an oxygen sensor, and a downstream-side catalyst larger in capacity than the upstream-side catalyst, successively from the upstream side.

However, if the foregoing techniques disclosed in Japanese Patent No. 2604840 and the JP-A-8-193537 are applied to such a system, there is a fear that the following inconvenience may occur.

According to the technique disclosed in Japanese Patent No. 2604840, a stop timing of the increase of the fuel injection quantity is determined by the oxygen sensor disposed downstream of catalyst, so in a system not provided with an oxygen sensor downstream of a downstream-side catalyst, it is impossible to determine a stop timing of the increase of the fuel injection quantity. Consequently, there sometimes is a case where a return is made to an ordinary feedback control in a state in which oxygen occluded by the downstream-side catalyst is not consumed to a sufficient degree. Therefore, the increase of the fuel injection quantity is not performed thereafter and it takes time for consumption of the oxygen occluded by the downstream-side catalyst. If the increase of the fuel injection quantity is performed in an actually completely consumed state of the oxygen occluded by the downstream-side catalyst, a rich gas will be released to the atmosphere, with a consequent likelihood of deteriorated emission.

On the other hand, according to the technique disclosed in the JP-A-8-193537, the amount of oxygen occluded in the catalytic converter is estimated. Therefore, it is here assumed that the amount of oxygen occluded by two catalytic converters is estimated and that an increase of the fuel injection quantity is executed on the basis of the estimated value. In the JP-A-8-193537, it is described that an increase of the fuel injection quantity is executed by setting the air-fuel ratio to a value richer by 0.5% to 2.0% than a stoichiometric air-fuel ratio.

However, even if an increase of the fuel injection quantity is set to a 0.5% richer value in terms of air-fuel ratio, it is likely that a long time will be required for the consumption of oxygen occluded by the catalytic converter, making a quick return to the ordinary feedback control impossible. A description will now be given of the case where an increase of the fuel injection quantity is set to a 2.0% richer value in terms of air-fuel ratio. Also in this case, since the amount of oxygen occluded by the catalytic converter is an estimated value, there is the possibility that a 2.0% richer exhaust gas will be released to the atmosphere despite the actual consumption of oxygen, that is, the emission will be deteriorated.

SUMMARY OF THE INVENTION

Accordingly, it is an object of the present invention to provide an emission control apparatus for engine capable of rapidly consuming oxygen occluded by a catalytic converter and diminishing emission released to the atmosphere even if an estimated value of the amount of oxygen occluded is deviated from an actual value.

For achieving the above-mentioned object, according to a first aspect of the present invention, an emission control apparatus for engine is applied to an engine control system that has a fuel supply stop means for stopping the supply of fuel injected by a fuel injection valve during operation of the engine. The emission control apparatus comprises a first occluded oxygen quantity estimating means for estimating a total amount of oxygen occluded by an upstream-side catalyst and oxygen occluded by a downstream-side catalyst, a first air-fuel ratio enriching means for enriching the air-fuel ratio of exhaust gas when a return is made from the state in which the supply of fuel is stopped by the fuel supply stop means, and a second air-fuel ratio enriching means which, upon lapse of a first predetermined period after execution of the enriching operation of the first air-fuel ratio enriching means, sets the air-fuel ratio of the exhaust gas to a rich ratio smaller than the degree of richness set by the first air-fuel ratio enriching means. The air-fuel ratio enriching operation of the second air-fuel ratio enriching means is stopped when the total amount of oxygen occluded in both upstream-side catalyst and downstream-side catalyst, which is estimated by the first occluded oxygen quantity estimating means, has become smaller than a predetermined value.

With this construction, for example in a state in which a large amount of oxygen is occluded in both upstream-side catalyst and downstream-side catalyst by fuel cut, the oxygen occluded by both catalytic converters is consumed rapidly by the first air-fuel ratio enriching means. Then, after the lapse of the first predetermined period, the oxygen occluded by both upstream-side catalyst and downstream-side catalyst is consumed by the second air-fuel ratio enriching means which is smaller in the degree of richness than the first air-fuel ratio enriching means, and when the occluded oxygen quantity estimated by the first occluded oxygen quantity estimating means has become smaller than the estimated value, the air-fuel ratio enriching operation of the second air-fuel ratio enriching means is stopped.

Therefore, after the lapse of the first predetermined period, the air-fuel ratio of the mixture fed into the exhaust passage is enriched constantly by the second air-fuel ratio enriching means, so even if an estimated total amount of oxygen occluded by both upstream-side catalyst and downstream-side catalyst is deviated from an actual value, it is possible to suppress the influence on the emission because the degree of richness is smaller than in the first air-fuel ratio enriching means.

Moreover, before the enriching operation of the second air-fuel ratio enriching means is executed, there is performed an air-fuel ratio enriching operation by the first air-fuel ratio enriching means, so that oxygen can be consumed in a short time in comparison with the case where the oxygen occluded by both upstream-side catalyst and downstream-side catalyst is consumed at an air-fuel ratio of a small richness degree.

By enriching the air-fuel ratio after the return from fuel cut there occurs a phenomenon that first the oxygen occluded by the upstream-side catalyst is consumed, followed by consumption of the oxygen occluded by the downstream-side catalyst. With such a phenomenon taken into account, since the first and second air-fuel ratio enriching means are switched from one to the other after the lapse of the predetermined period, there is the possibility that an air-fuel ratio enriching operation will be carried out by the first air-fuel ratio enriching means irrespective of the oxygen in the upstream-side catalyst having been consumed.

Consequently, the upstream-side catalyst is likely to assume a rich condition and there is a fear that a smooth return to feedback control may be impossible.

In this connection, according to an embodiment of the present invention, if it is determined that the first predetermined period has elapsed when an air-fuel ratio detected by an oxygen sensor exceeds a second predetermined value, it is possible to effect switching from the air-fuel ratio enriching operation of the first air-fuel ratio enriching means to that of the second air-fuel ratio enriching means when the oxygen occluded by the upstream-side catalyst has been consumed. The air-fuel ratio may be indicated by an output corresponding to an oxygen concentration.

With this construction, it is possible to determine that the oxygen occluded by the upstream-side catalyst has been consumed sufficiently by the first air-fuel ratio enriching means after the return from fuel cut, and after this determination it is possible to effect switching to the second air-fuel ratio enriching means. That is, it is possible to diminish the richness degree of the exhaust gas fed to the upstream-side catalyst at the time of return to a normal control such as feedback control and hence possible to effect a smooth return to the normal control after the end of air-fuel ratio control made by the second air-fuel ratio enriching means.

According to an embodiment of the present invention, when the occluded oxygen quantity estimated by the first occluded oxygen quantity estimating means is smaller than a third predetermined value, it is determined that the first predetermined period has elapsed. That is, by setting the third predetermined value for determining an occluded oxygen quantity to a value indicating that the oxygen occluded by the upstream-side catalyst has been consumed, there can be obtained a similar advantage described above.

According to an embodiment of the present invention, while the supply of fuel from the fuel injection valve is stopped by the fuel supply stop means, the first occluded oxygen quantity estimating means estimates the amount of oxygen occluded by both upstream-side catalyst and downstream-side catalyst on the basis of the amount of intake air. Since the amount of oxygen fed to the catalysts during fuel cut is proportional to the amount of intake air, the amount of oxygen occluded by both upstream- and downstream-side catalysts can be estimated accurately on the basis of the amount of intake air.

According to an embodiment of the present invention, as the amount of oxygen estimated by the first occluded oxygen quantity estimating means, there may be estimated the amount of oxygen occluded by both upstream-side catalyst and downstream-side catalyst on the basis of a period during which the supply of fuel from the injection valve is stopped by the fuel supply stop means. This permits the amount of oxygen occluded by both upstream-side catalyst and downstream-side catalyst to be estimated in a simpler manner than described above.

According to an embodiment of the present invention, an emission control apparatus for engine further comprises a determining means for determining that a leaner state of the exhaust gas air-fuel ratio detected by the first air-fuel ratio detecting means than a fourth predetermined value has continued for a second predetermined period.

In this case, the first air-fuel ratio enriching means enriches the exhaust gas air-fuel ratio when it is determined by the determining means that a leaner state of the exhaust gas air-fuel ratio than the fourth predetermined value has continued for the second predetermined period and when the exhaust gas air-fuel ratio has exceeded a fifth predetermined value richer than the fourth predetermined value from the leaner state than the fourth predetermined value. The second air-fuel ratio enriching means, upon lapse of a predetermined period after the execution of the enriching operation of the first air-fuel ratio enriching means, sets the exhaust gas air-fuel ratio to a rich value smaller than the degree of richness set by the first air-fuel ratio enriching means. The air-fuel ratio enriching operation of the second air-fuel ratio enriching means is stopped when the total amount of oxygen occluded in both upstream-side catalyst and downstream-side catalyst which is estimated by the occluded oxygen quantity estimating means has become smaller than the predetermined value.

Even when the air-fuel ratio controlled for an internal combustion engine is lean, oxygen is occluded by both upstream-side catalyst and downstream-side catalyst. Therefore, by determining such conditions as permit oxygen to be occluded by both upstream-side and downstream-side catalyst and by using the first and second air-fuel ratio enriching means, it is possible to obtain a similar advantage as described above even in any other case of oxygen being occluded by both upstream-side catalyst and downstream-side catalyst than during fuel cut.

According to an embodiment of the present invention, an emission control apparatus for engine further comprises a second occluded oxygen quantity estimating means for estimating the amount of oxygen occluded by the downstream-side catalyst, and wherein the air-fuel ratio enriching operation of the second air-fuel ratio enriching means is stopped when the amount of oxygen estimated by the second occluded oxygen quantity estimating means has become smaller than the first predetermined value.

With this construction, since the amount of oxygen occluded by the downstream-side catalyst can be estimated, it is possible to stop the enriching operation of the second air-fuel ratio enriching means when the oxygen occluded by the downstream-side catalyst has been consumed.

According to an embodiment of the present invention, an emission control apparatus for engine further comprises a deoccluded oxygen quantity computing means for computing the amount of oxygen which is deoccluded from the upstream-side catalyst by the first air-fuel ratio enriching means, and wherein on the basis of the deoccluded oxygen quantity from the upstream-side catalyst computed by the deoccluded oxygen quantity computing means, the second occluded oxygen quantity estimating means estimates the amount of oxygen occluded by the downstream-side catalyst.

The amount of oxygen deoccluded by the first air-fuel ratio enriching means corresponds to the amount of oxygen occluded by the upstream-side catalyst. The upstream-side catalyst and downstream-side catalyst are different in point of capacity, but their occluded oxygen quantities are correlated with each other. Therefore, the amount of oxygen occluded by the downstream-side catalyst can be estimated with high accuracy on the basis of the deoccluded oxygen quantity computed.

According to an embodiment of the present invention, the first occluded oxygen quantity estimating means compares the amount of oxygen occluded by both upstream-side catalyst and downstream-side catalyst which amount is obtained by estimation, with a saturated amount of oxygen occluded by both upstream-side catalyst and downstream-side catalyst. The first occluded oxygen quantity estimating means sets the amount of oxygen occluded by both upstream-side catalyst and downstream-side catalyst to the stored value in response to the result of comparing the estimated value with the stored value.

This permits an occluded oxygen quantity to be estimated with high accuracy even when the amount of oxygen occluded by both upstream-side catalyst and downstream-side catalyst reaches saturation.

If the stored value of the saturated amount of occluded oxygen were deviated from the actual saturated amount of occluded oxygen, enriching would be performed by the second air-fuel ratio enriching means in an actually consumed state of oxygen occluded by both upstream-side catalyst and downstream-side catalyst, or the second air-fuel ratio enriching means might be stopped in an unconsumed state of oxygen.

A description will now be given about such a case. In this embodiment, as noted earlier, the saturated amount of oxygen occluded by the upstream-side catalyst and that occluded by the downstream-side catalyst are correlated with each other. Therefore, each of such saturated amounts can be obtained on the basis of the stored value. Further, the saturated amount of oxygen occluded by the upstream-side catalyst corresponds to the amount of oxygen deoccluded from the same catalyst. Since the amount of oxygen deoccluded from the upstream-side catalyst can be determined from the state in which the output of the oxygen sensor has reached a predetermined degree of richness, the saturated amount of oxygen occluded by the upstream-side catalyst can be determined from the deoccluded oxygen quantity.

According to an embodiment of the present invention, the stored value is corrected on the basis of the deoccluded oxygen quantity from the upstream-side catalyst computed by the deoccluded oxygen quantity computing means. With this construction, even if the stored value of the saturated amount of oxygen is deviated from the actual saturated amount of oxygen, it can be corrected on the basis of the deoccluded oxygen quantity from the upstream-side catalyst computed by the deoccluded oxygen quantity computing means.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Figure 1:
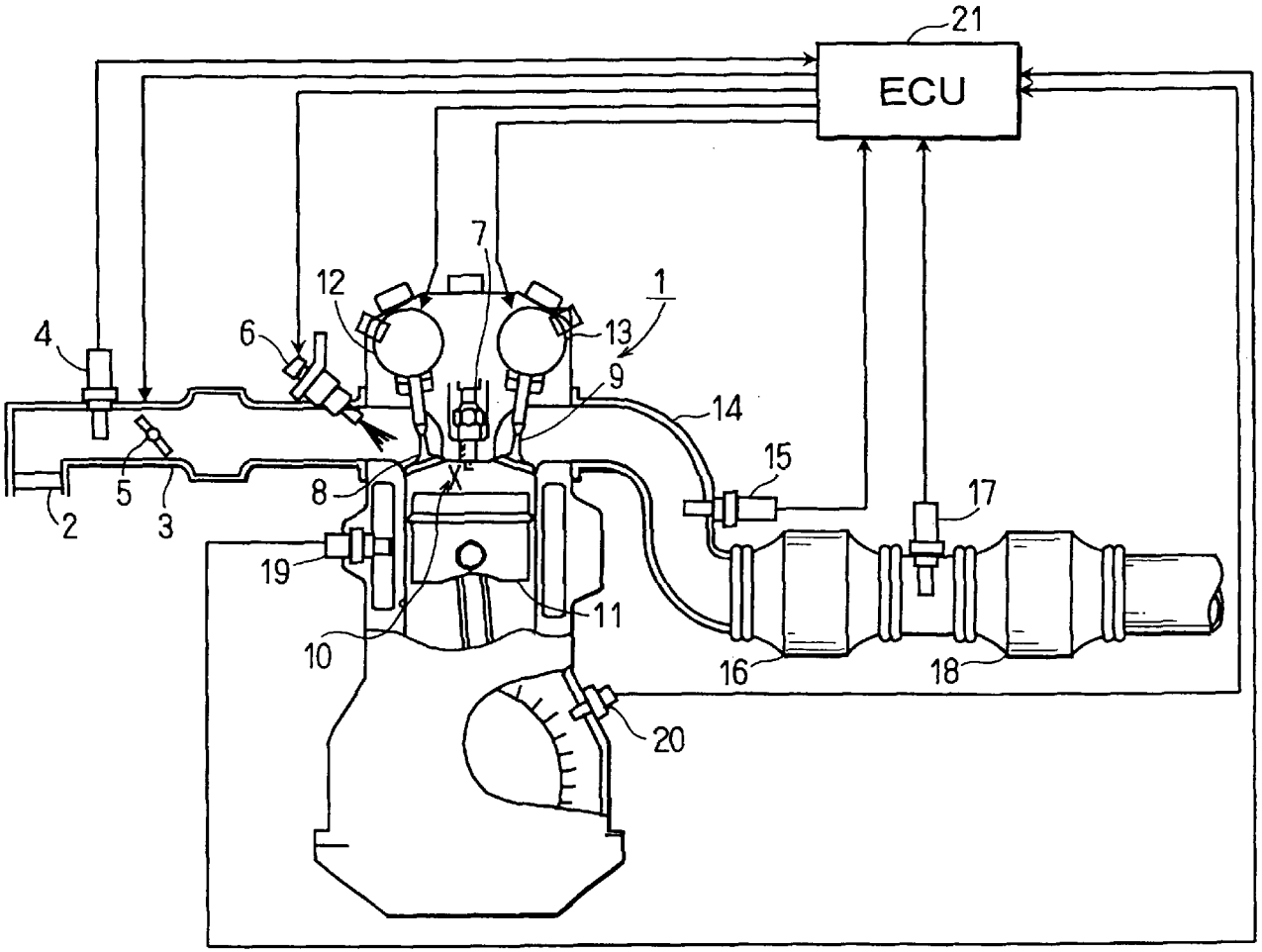
FIG. 1 is a diagram showing an engine components and engine control system according to a first embodiment of the present invention.

Embodiments of the present invention will be described in detail with reference to the accompanying drawings. FIG. 1 illustrates an entire construction schematically, embodying the present invention. As shown in FIG. 1, an engine 1 is constructed as a four-cylinder, four-cycle, spark ignition type. In the engine 1, air is introduced through an intake passage 3 which is for conducting the air to a combustion chamber 10 in the engine. An air cleaner 2 for purifying the intake air from an upstream side is mounted in the intake passage 3. The purified intake air passes through an air flow meter 4 which is disposed downstream of the air cleaner 2 for detecting an amount of the intake air.

The degree of opening of a throttle valve 5 disposed downstream of the air flow meter 4 is adjusted to adjust the amount of the intake air to be fed to the combustion chamber 10. The intake air thus adjusted, upon injection of fuel by means of an injector 6 disposed in each of the manifold pipe of an intake manifold branching from the intake passage 3, is mixed with the injected fuel. The resulting air-fuel mixture is fed to the combustion chamber 10 upon opening of an intake valve 8 and a spark plug 7 sparks at a predetermined timing for the air-fuel mixture thus fed, whereby the mixture burns. As a result, a piston 11 disposed in the combustion chamber 10 of the engine 1 is depressed to create a rotating torque for rotating a crankshaft of the engine.

The intake valve 8 and an exhaust valve 9 are adapted to open and close in synchronism with rotation of a camshaft. Setting their timings and lift quantities variably permits controlling the state of combustion to a state suitable for an engine running condition. As mechanisms for setting opening/closing timings and lift quantities of the intake valve 8 and exhaust valve 9, there are provided variable valve mechanisms 12 and 13 respectively.

On the other hand, the combustion gas generated by combustion is conducted from an exhaust manifold corresponding to each cylinder in the engine 1 to an exhaust passage 14 through a combining junction of the manifold, and is released to the atmosphere. At this time, hazardous components, e.g., CO, HC, NOx, contained in the exhaust gas are purified by two catalytic converters disposed in the exhaust passage 14. A catalytic converter, i.e., an upstream-side catalyst 16 disposed on the engine 1 side in the exhaust passage is small in capacity for quick completion of its warm-up in the cold and functions as a so-called start catalyst. On the other hand, a catalytic converter, i.e., a downstream-side catalyst 18 is larger in capacity than the upstream-side catalyst 16, and functions as a catalyst capable of purifying even a large amount of exhaust gas. There may be adopted a construction wherein catalytic converters of about the same capacities are arranged on upstream and downstream sides respectively.

In the exhaust passage 14, a linear A/F sensor 15 for linearly detecting an air-fuel ratio of exhaust gas is disposed upstream of the upstream-side catalyst 16. An oxygen sensor 17 for detecting an oxygen concentration of the exhaust gas and outputting whether the exhaust gas is rich or lean is disposed between the upstream-side catalyst 16 and the downstream-side catalyst 18. The oxygen sensor 17 is formed of a solid zirconia electrolyte. The output voltage of the oxygen sensor 17 abruptly changes at a predetermined air-fuel ratio. Further, there are provided a water temperature sensor 19 for detecting a cooling water temperature Thw in the engine 1 and a crank angle sensor 20 for detecting a rotational angle position of a crankshaft.

According to this embodiment, in the engine 1 thus constructed, an air-fuel ratio control is conducted by means of an electronic control unit (ECU) 21 on the basis of output values provided from the above various sensors as operating conditions of the engine 1.

The ECU 21 is constructed as a logic operation circuit comprising principally a Central Processing Unit, a Read-Only Memory, a Random Access Memory, and a backup RAM. In this embodiment, with the ECU 21, a so-called feedback control is executed as the air-fuel ratio control. This control will be outlined below.

First, a description will be given of a main air-fuel ratio feedback control in this embodiment. The degree of opening of the throttle valve 5 is adjusted so as to afford a predetermined air volume in accordance with a depressed degree of an accelerator operated by a driver. This intake air is detected by the air flow meter 4 and for the detected intake air, there is formed an air-fuel mixture by the injection of fuel with the injector 6. At this time, for setting a fuel injection time by the injector 6, a basic injection time Tp is accessed from a map which is preset from intake air volume and engine speed NE as operating conditions.

Then, the basic injection time Tp is multiplied by various correction coefficients to set a fuel injection time TAU so as to afford a target air-fuel ratio $\lambda$TG.

The various correction coefficients include a correction coefficient which is set on the basis of the cooling water temperature Thw of the engine 1 detected by the water temperature sensor 19 and a correction coefficient which is set so that an actual air-fuel ratio $\lambda$ detected by the linear A/F sensor 15 becomes coincident with a target air-fuel ratio $\lambda$TG.

Further, in this embodiment, there is performed a sub-feedback control for air-fuel ratio. According to this sub-feedback control, the target air-fuel ratio $\lambda$TG is changed so that a cycle ratio and an area ratio of rich/lean states detected by the oxygen sensor 17 become constant. Thus, the amount of fuel to be injected is controlled by both main feedback control and sub-feedback control in such a manner as to afford an air-fuel ratio corresponding to the highest purification rate for hazardous components purified by the downstream-side catalyst 18, thereby making it possible to diminish emission.

Figure 2:
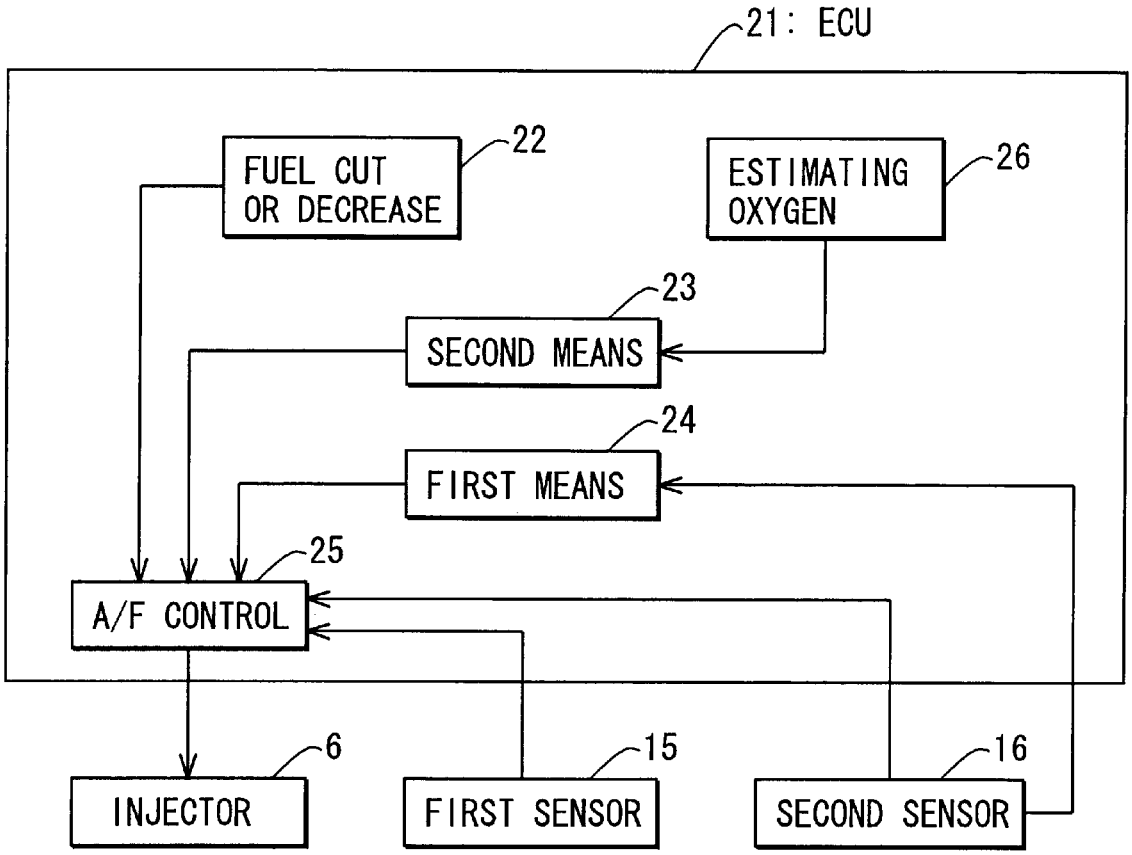
FIG. 2 is a block diagram showing functional components according to the first embodiment of the present invention.

In this embodiment, such an air-fuel ratio feedback control system is characterized by the control which is carried out after the return from fuel cut. Characteristic portions of this embodiment will now be described in detail with reference to FIGS. 2 to 13. First, an outline of this embodiment will be given with reference to FIG. 2. The block diagram of FIG. 2 illustrates an air-fuel ratio control which is conducted after the return from fuel cut by ECU 21 in this embodiment. In the case where a condition for stopping the injection of fuel is established during operation of the engine 1, the injection of fuel by the injector 6 in an air-fuel ratio control means 25 is stopped by a fuel injection stop means 22. Likewise, in the fuel injection stop means 22, if a condition for decreasing the amount of fuel to be injected is established during operation of the engine 1, a correction is made to decrease the amount of fuel injected from the injector 6.

When in this way the amount of fuel is decreased or the injection thereof is stopped, oxygen is fed to and occluded by both upstream-side catalyst 16 and downstream-side catalyst 18. When a fuel injection stop command provided from the fuel injection stop means 22 is terminated, a return is made from fuel cut and thereafter a setting command is issued from a first air-fuel ratio enriching means 24 to the air-fuel ratio control means 25 so that the target air-fuel ratio λTG becomes 0.990. Then, output signals from the first and second air-fuel ratio sensors 15, 16 are applied to the air-fuel ratio control means 25, in which a feedback control is executed on the basis of both target air-fuel ratio λTG and actual air-fuel ratio λ, and a sub-feedback control is also executed to correct the target air-fuel ratio λTG.

On the other hand, in the case where an output signal from the second air-fuel ratio sensor indicates a predetermined rich state, that is, when the oxygen occluded by the upstream-side catalyst 16 has been consumed, a shift is made from the air-fuel control by the first air-fuel ratio enriching means to the air-fuel ratio control by the second air-fuel ratio enriching means, in which 0.995 is set as the target air-fuel ratio λTG. Further, when it is determined that the oxygen occluded by both upstream- and downstream-side catalysts 16, 18, which is estimated by an occluded oxygen quantity estimating means 26, has been consumed, the air-fuel ratio enriching operation of the second air-fuel ratio enriching means is stopped and a return is made to the normal feedback control/sub-feedback control.

Next, this embodiment will be described in more detail with reference to FIGS. 3 to 10. A description will first be given of a processing for setting a flag which is for the execution of fuel cut in this embodiment, with use of a Fuel Cut Flag setting routine shown in FIG. 3. This routine is started at every predetermined period, e.g., 32 milliseconds. In Step S101, it is determined whether 1 is set to a fuel cut flag XFC at present. In the normal air-fuel ratio feedback state, the answer in Step S101 is negative (NO) (XFC=0). Then, the processing of the CPU advances to Step S102, then in steps S102 and S103 the CPU determines fuel cut execution conditions.

More specifically, in Step S102, the CPU determines whether an idle switch is ON, then in Step S103, determines whether the engine speed NE exceeds a predetermined rotational speed, e.g., 1400 rpm in this embodiment, which is for determining the execution of fuel cut. In this case, if the answer in one of steps S102 and S103 is negative (NO), the CPU determines that the fuel cut execution conditions do not exist, and the processing thereof advances to Step S104. In Step S104, the CPU clears a delay counter CDFC to 0 which counter makes counting to start fuel cut, and terminates this routine.

If the answers in both steps S102 and S103 are affirmative (YES), the CPU determines that the fuel cut execution conditions exist, and the processing thereof advances to Step S105, in which the CPU determines whether the count value of the delay counter CDFC is 0. In this case, since the count value of CDFC is initially 0, the answer in Step S105 is affirmative (YES), and the processing of the CPU 32 advances to Step S106. In Step S106, the CPU sets the delay counter CDFC to 1 and terminates this routine.

After the delay counter CDFC has been set to 1, the answer in Step S105 becomes negative (NO), and in Step S107 the CPU determines whether the count value of the delay counter CDFC exceeds a predetermined value CK1, e.g., a count value corresponding to 0.5 seconds. The delay counter CDFC is counted in accordance with the routine shown in FIG. 4. To be more specific, in Step S201 in FIG. 4, the CPU determines whether the delay counter CDFC is 0, and if the answer is affirmative, the CPU terminates this routine. On the other hand, if the answer in Step S201 is not 0, the processing flow advances to Step S202, in which the CPU increments the delay counter CDFC to 1 and terminates this routine. That is, after the delay counter CDFC is set to 1 in Step S106 in FIG. 3, the delay counter CDFC is incremented by 1 at every execution, e.g., every 32 milliseconds, of the processing of FIG. 4.

Figure 3:
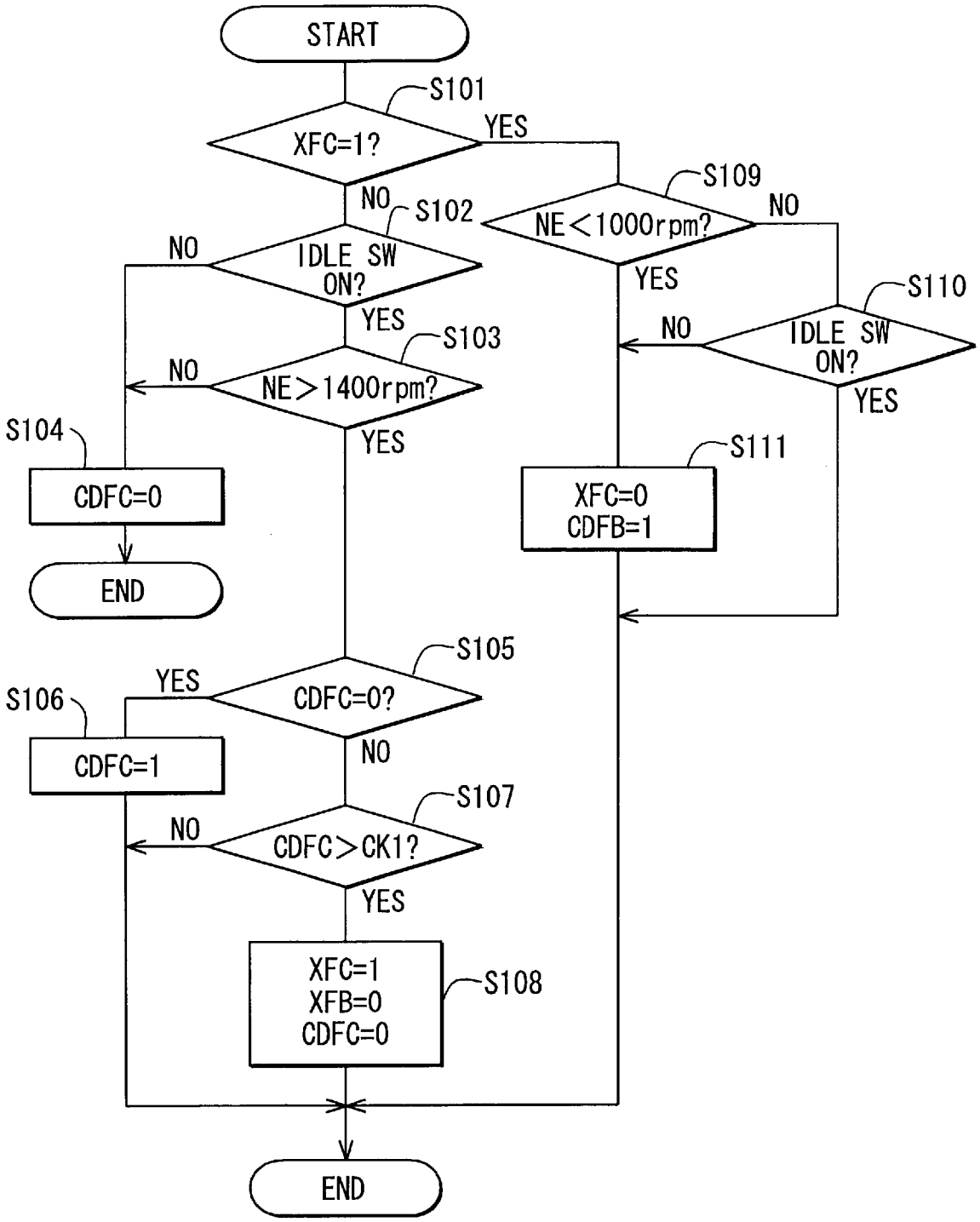
FIG. 3 is a flowchart for setting a Fuel Cut Flag, according to the first embodiment of the present invention.
Figure 4:
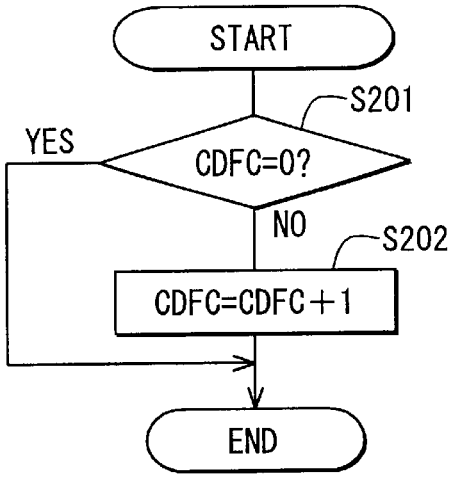
FIG. 4 is a flowchart showing a count processing carried out by a delay counter CDFC according to the first embodiment of the present invention.

With the delay counter CDFC≦CK1, and if the answer in Step S107 in FIG. 3 is negative (NO), the CPU terminates this routine as it is. With the delay counter CDFC≦CK1, and if the answer in Step S107 is affirmative (YES), the processing flow advances to Step S108, in which the CPU sets the fuel cut flag XFC to 1, a feedback control flag XFB to 0, and the delay counter CDFC to 0, and terminates this routine.

On the other hand, if 1 is set to the fuel cut flag XFC as noted above, the answer in Step S101 becomes affirmative (YES). Consequently, the processing flow advances to Step S109, in which the CPU determines whether the engine speed NE is below a predetermined rotational speed, e.g., 1000 rpm in this embodiment, which is for determining the end of fuel cut. Further, in Step S110, the CPU determines whether the idle switch is ON.

In this case, if the engine speed NE is not lower than 1000 rpm and the idle switch is ON (the answer in Step S109 is negative (NO) and the answer in Step S110 is affirmative (YES)), the CPU terminates this routine. If the engine speed NE is lower than 1000 rpm or if the idle switch is OFF (the answer in Step S109 is affirmative (YES) or the answer in Step S110 is negative (NO)), then in Step S111 the CPU sets the fuel cut flag XFC to 0 and the delay counter CDFB to 1, and terminates this routine.

Figure 5:
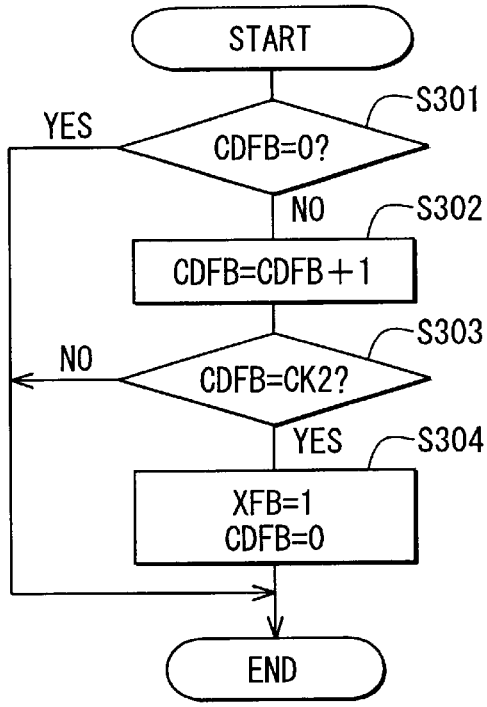
FIG. 5 is a flowchart showing a count processing carried out by a delay counter CDFB according to the first embodiment of the present invention.

The delay counter CDFB is incremented in accordance with the routine shown in FIG. 5. A description will now be given of processings performed by the delay counter CDFB.

The CPU starts the processing routine of FIG. 5 in synchronism with the input of a TDC signal which is detected by the crank angle sensor 20. First in Step S301 the CPU determines whether the delay counter CDFB is 0, and if the answer is affirmative, the CPU terminates this routine, while if the answer is negative, i.e., ≠0, in other words, if the delay counter CDFB is set to 1 in Step S111 in FIG. 2, the processing flow advances to Step S302, in which the CPU increments the delay counter CDFB by 1.

Thereafter, in Step S303, the CPU determines whether the count value of the delay counter CDFB has reached a predetermined value, e.g., 30 counts. If the count value has not reached the predetermined value then the answer is negative (NO), the CPU terminates this routine. On the other hand, if the delay counter CDFB has reached the predetermined value CK2, i.e., if the answer in Step S303 is affirmative (YES), the processing flow advances to Step S304, in which the CPU sets the feedback control flag XFB to 1 and the delay counter CDFB to 0, and terminates this routine.

Figure 6:
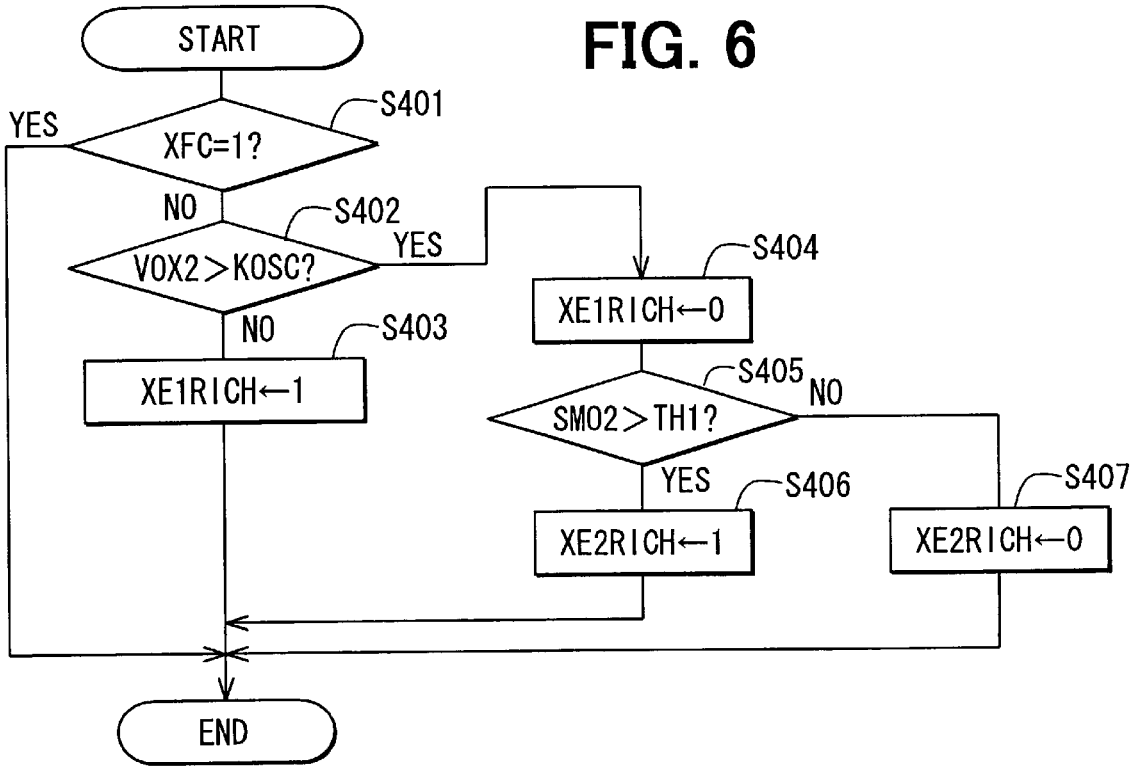
FIG. 6 is a flowchart for determining an air-fuel ratio enriching request according to the first embodiment of the present invention.

Next, the following description is provided about an air-fuel ratio control which is conducted after the end of fuel cut, with reference to an air-fuel ratio enriching request flag setting routine shown in FIG. 6. In this routine, an air-fuel ratio enriching request flag XE1RICH is switched to a flag XE2RICH for changing the target air-fuel ratio λTG in accordance with the degree of progress of the control which is executed after the return from fuel cut.

The timing of the switching is when the air-fuel ratio detected by the oxygen sensor 17 has become richer than a predetermined degree of richness.

More particularly, it is intended that the amount of oxygen occluded by the two catalytic converters be saturated by fuel cut and that the saturated oxygen be consumed quickly after the return from fuel cut and thereby the normal feedback control/sub-feedback control be executed.

For achieving this purpose, 1 is set to the air-fuel ratio enriching request flag XE1RICH after the return from fuel cut to enrich the exhaust gas to be fed to the upstream-side catalyst 16, thereby allowing the oxygen occluded by the upstream-side catalyst 16 to be consumed rapidly. Thus, if the output of the oxygen sensor 17 indicates a rich condition, it follows that the oxygen occluded by the upstream-side catalyst 16 has been consumed suitably. During this period, even if a rich gas is fed to the upstream-side catalyst 16, the oxygen occluded by the downstream-side catalyst 18 is not consumed because an exhaust gas with an air-fuel ratio close to the stoichiometric air-fuel ratio is fed to the downstream-side catalyst 18 due to the purifying action of the upstream-side catalyst 16.

Therefore, when an output value of the oxygen sensor 17 indicates a predetermined degree of richness, the CPU sets the air-fuel ratio enriching request flag XE2RICH to 1 and an exhaust gas smaller in the degree of richness than the above richness is fed to the upstream-side catalyst 16. As a result, since the amount of oxygen occluded by the upstream-side catalyst 16 is an appropriate amount, the oxygen occluded by the downstream-side catalyst 18 is consumed quickly, thus permitting a quick return to the normal feedback control/sub-feedback control. In the flowchart of FIG. 6, the air-fuel ratio enriching request flag XE1RICH is set taking these points into account. A more detailed description will be given below.

First, in Step S401, the CPU determines whether the fuel cut flag XFC is 1. If fuel cut is being conducted, that is, if the fuel cut flag XFC is 1, the answer in Step S401 is affirmative (YES) and the CPU terminates this routine. On the other hand, if fuel cut is not being conducted, the answer in Step S401 is negative (NO) and processings of Step S402 and subsequent steps are executed.

In the processings of Step S402 and subsequent Steps, the CPU sets a flag for setting a target air-fuel ratio as an air-fuel ratio control subsequent to the return from fuel cut. The details of this flag will be described later. The CPU set both air-fuel ratio enriching request flags XE1RICH and XE2RICH according to the degree of progress of control and controls the air-fuel ratio. First, in Step S402, the CPU determines whether a voltage value VOX2 detected by the oxygen sensor 17 has exceeded a predetermined voltage KOSC.

The oxygen sensor 17 has an output characteristic such that the air-fuel ratio changes abruptly in the vicinity of the stoichiometric air-fuel ratio. More specifically, an output of a large VOX2 value is provided for a rich air-fuel ratio, while an output of a small VOX2 value is provided for a lean air-fuel ratio.

If the voltage value VOX2 does not exceed the predetermined value KOSC, the CPU determines that the oxygen occluded by the upstream-side catalyst 16 has not been consumed sufficiently, that is, the answer in Step S402 is negative (NO), and the processing flow advances to Step S403. In Step S403, the CPU sets 1 to the air-fuel ratio enriching request flag XE1RICH for enriching the air-fuel ratio and terminates this routine. That is, when fuel cut is executed, the amount of oxygen occluded by the upstream-side catalyst 16 and that occluded by the downstream-side catalyst 18 are both large, so that after the return from fuel cut, the amount of fuel injected is increased, allowing the oxygen occluded by the upstream-side catalyst 16 to be consumed quickly, in order to enrich the air-fuel ratio of the exhaust gas fed to the upstream-side catalyst.

On the other hand, if in Step S402 the voltage value VOX2 detected by the oxygen sensor 17 is larger than the predetermined voltage KOSC, the answer in Step S402 is affirmative (YES) and the processing flow advances to Step S404. That the voltage value VOX2 of the oxygen sensor 17 is larger than the predetermined voltage KOSC, that is, it indicates a rich output, meaning that the oxygen occluded by the upstream-side catalyst has been consumed sufficiently by the increased amount of fuel subsequent to the return from fuel cut. Therefore, when the voltage value VOX2 of the oxygen sensor 17 has exceeded the predetermined value KOSC, the exhaust gas air-fuel ratio is set so that the oxygen occluded by the downstream-side catalyst 18 is consumed.

To be more specific, the CPU sets the air-fuel ratio enriching flag XE1RICH to 0 in Step S404 and the processing flow advances to Step S405, in which the CPU determines whether an occluded oxygen quantity TH1 to be described later is larger than, e.g., 0. If the occluded oxygen quantity SMO2 is larger than the predetermined value TH1, the answer in Step S405 is affirmative (YES), and the processing flow advances to Step S406, in which the CPU sets the air-fuel ratio enriching request flag XE2RICH to 1 and terminates this routine. On the other hand, if it is determined that the occluded oxygen quantity SMO2 is not larger than the predetermined value TH1, the answer in Step S405 is negative (NO) and the processing flow advances to Step S407, in which the CPU sets the air-fuel ratio enriching request flag XE2RICH to 0 and terminates this routine.

Thus, in the air-fuel ratio enriching request flag setting routine shown in FIG. 6, a flag for enriching the air-fuel ratio is set on the basis of the output value from the oxygen sensor 17 and the occluded oxygen quantity SMO2, as an air-fuel ratio control after the return from fuel cut. The details of the occluded oxygen quantity SMO2 referred to in this flowchart will be described later.

Figure 7:
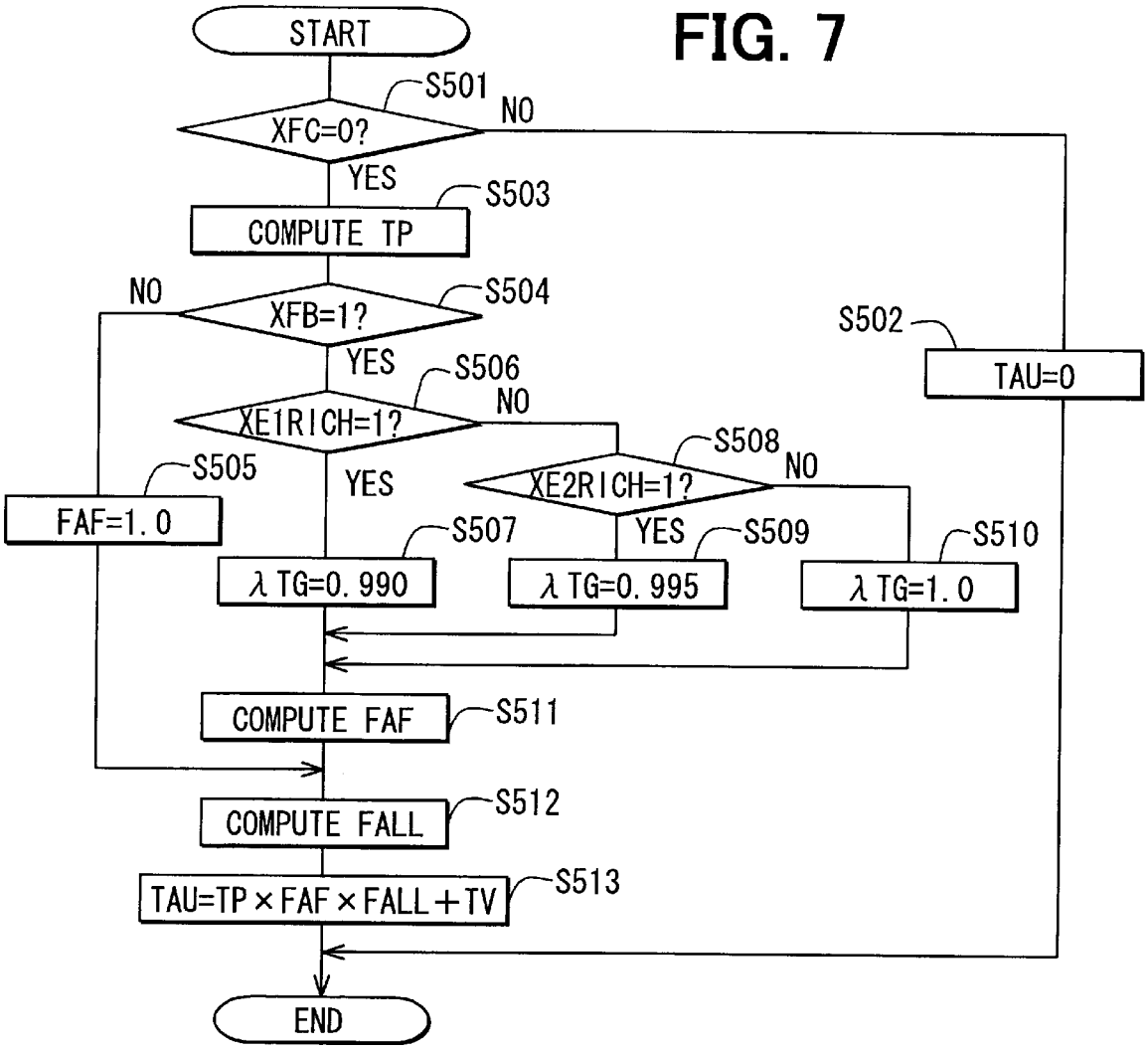
FIG. 7 is a flowchart showing a fuel injection control according to the first embodiment of the present invention.

Next, a description will be given of the fuel injection volume control in this embodiment with reference to the fuel injection volume calculating routine shown in FIG. 7. Particularly, a detailed description will be given of the air-fuel ratio control which is executed on the basis of the air-fuel ratio enriching request flags XE1RICH and XE2RICH both set in the air-fuel ratio enriching request flag setting routine of FIG. 6. First in Step S501 the CPU determines whether the fuel cut flag XFC is 0. If the fuel cut flag XFC is 1, that is, if fuel cut is being executed, the answer in Step S501 is negative (NO). Then, in Step S502, the CPU sets 0 to the fuel injection time TAU and terminates this routine. On the other hand, if the fuel cut flag XFC is 0, that is, if fuel cut is not being executed, the answer in Step S501 is affirmative (YES) and the processing flow advances to Step S502.

In Step S502, a basic fuel injection time Tp in the fuel injection control is set in accordance with a map. In this map, for example, running conditions of the engine are divided using as parameters both engine speed NE which is calculated on the basis of a TDC signal detected by the crank angle sensor 20 and the amount of intake air detected by the air flow meter 4, and a basic fuel injection time Tp based on the combination of these parameters is determined beforehand by fitting for example and is stored in a ROM or the like of ECU 21. Then, the basic injection time Tp is accessed by the aforesaid map and the processing flow advances to Step S504.

In Step S504, the CPU determines whether the feedback flag XFB is 1. If the feedback flag XFB is 0, the answer in Step S504 is negative (NO) and the processing flow advances to Step S505. In Step S505, the CPU sets 1.0 to a feedback correction coefficient FAF, executes processings of steps S512 and S513 and terminates this routine, which processings will be described later.

If it is determined in Step S504 that the feedback flag XFB is 1, the answer in Step S504 is affirmative (YES) and the processing flow advances to Step S506. In Step S506, it is determined whether the air-fuel ratio enriching request flag XE1RICH which has been set in the air-fuel ratio enriching request flag setting routine of FIG. 6 is 1. If the flag XE1RICH is 1, the answer in Step S506 is affirmative (YES) and the processing flow advances to Step S507. In Step S507, the CPU sets 0.990 as the target air-fuel ratio λTG, then executes the processings of steps S511 to S513.

On the other hand, if the air-fuel ratio enriching request flag XE1RICH is not 1, the answer in Step S506 is negative (NO) and the CPU executes the processing of Step S508. In Step S508, it is determined whether the air-fuel ratio enriching request flag XE2RICH which has been set in the air-fuel ratio enriching request flag setting routine of FIG. 6 is 1. If the flag XE2RICH is 1, the CPU sets 0.995 to the target air-fuel ratio λTG and executes the processings of steps S511 to S513. Unless the flag XE2RICH is 1, the CPU sets 1.0 to the target air-fuel ratio λTG, executes the processings of steps S512 to S513 and terminates this routine.

Description is now directed to the processings of steps S511 to S513. In Step S511, a feedback correction coefficient FAF is computed. The feedback correction coefficient is computed as a correction coefficient for the basic injection time Tp on the basis of a deviation between the target air-fuel ratio λTG and an actual air-fuel ratio λ which is detected by the linear A/F sensor 15.

Thus, in this step, the CPU computes the feedback correction coefficient FAF on the basis of a deviation between the target air-fuel ratio λTG which has been set in any of steps S507, S509 and S510 and an actual air-fuel ratio k detected by the linear A/F sensor 15.

Then, in Step S512, the CPU computes a correction coefficient FALL for increasing the amount of fuel injected which increase is performed when the cooling water temperature in the engine 1 detected by the cooling water sensor 20 is low or at the time of a high load operation or acceleration as an engine operating condition, and the processing flow advances to Step S513. In Step S513, the basic injection time is multiplied by both feedback correction coefficient FAF set in Step S505 or computed in Step S511 and the correction coefficient FALL computed in Step S512, and an invalid injection time Tv is added, to compute a final fuel injection time TAU by TAU=Tp×FAF×FALL+Tv, then the CPU terminates this routine.

Thus, according to the flowchart in question, the target air-fuel ratio λTG is set on the basis of the states of both air-fuel ratio enriching request flags XE1RICH and XE2RICH. More specifically, when air-fuel ratio enriching request flag XE1RICH is 1, the target air-fuel ratio λTG is set so as to be 10% richer than the stoichiometric air-fuel ratio. When the air-fuel ratio enriching request flag XE2RICH is 1, the target air-fuel ratio λTG is set so as to be 5% richer than the stoichiometric air-fuel ratio. Further, when the occluded oxygen quantity SMO2 to be described later is, for example, below 0 as a predetermined value, the air-fuel ratio enriching request flat XE2RICH becomes 0 and the CPU terminates the air-fuel control after the return from fuel cut and executes the normal feedback control/sub-feedback control.

The reason why the target air-fuel ratio λTG is switched from 0.990 to 0.995 in this embodiment will now be described. While the oxygen occluded by the downstream-side catalyst 18 is consumed, a rich gas is fed in this embodiment. The supply of the rich gas is stopped when the oxygen occlude by the downstream-side catalyst 18 has been suitably consumed, and a return is made to the normal feedback control/sub-feedback control. However, in the event of offset of the determination timing, there is a fear that the rich gas may not be purified to a satisfactory extent and be released to the atmosphere past the catalyst. Therefore, for the purpose of diminishing the rich gas component discharged during this period, the target air-fuel ratio λTG is switched from 0.990 to 0.995 when the oxygen occluded by the downstream-side catalyst is consumed.

The following description is now provided about how to compute the occluded oxygen quantity SMO2 in the downstream-side catalyst 18. The occluded oxygen quantity is an estimated value of the amount of oxygen occluded in each catalyst. In the system of this embodiment, an air-fuel ratio sensor is not disposed downstream of the downstream-side catalyst 18, so it is necessary to estimate how much oxygen is occluded by the downstream-side catalyst 18. In this connection, the processing for estimating an occluded oxygen quantity in the downstream-side catalyst 18 will now be described in detail with reference to an occluded oxygen quantity SMO2 computing routine shown in FIG. 8, which is started at every 2 milliseconds for example. This routine is started upon start-up of fuel cut.

First, in Step S601, the CPU determines whether the fuel cut flag is 1, and if the answer is affirmative, the processing flow advances to Step S602, in which an oxygen occluding speed SMO2-FC is computed because fuel cut is being executed. This computation is done using the following arithmetic expression:

$$SMO2\text{-}FC = KSMO2\text{-}FX \times (GA \times T)$$

where T stands for a cycle of arithmetic operation.

In the above expression, a predetermined value KSMO2-FC takes a value corresponding to the oxygen concentration in the atmosphere, assuming that the atmosphere is fed into the exhaust passage 14 during fuel cut. Then, the oxygen occluding speed SMO2-FC of oxygen fed to the catalyst is computed by multiplying the predetermined value KSMO2-FC by both intake air volume GA detected by the air flow meter 4 and the cycle of arithmetic operation.

Next, in Step S603, 0 is set to a deoccluded oxygen quantity PGO2-1 of oxygen deoccluded from the upstream-side catalyst 16. That is, if fuel cut is being executed, it is determined that there is no oxygen deoccluded from the upstream-side catalyst 16, and the processing flow advances to Step S604. In Step S604, 0 is set to a deoccluded oxygen quantity PGO2-2 of oxygen deoccluded from the downstream-side catalyst 18. This is also because it is assumed that there is no oxygen deoccluded from the downstream-side catalyst 18 during fuel cut. Then, in Step S605, there is determined a total occluded oxygen quantity SMO2 of oxygen occluded by the upstream-side catalyst 16 and that occluded by the downstream-side catalyst 18. In Step S605, since fuel is being cut and both deoccluded oxygen quantities PGO2-1, PGO2-2 are 0, a total value of both oxygen occluding speed SMO2-FC computed in Step S602 and the occluded oxygen quantity SMO2 of the last time is inputted as the occluded oxygen quantity SMO2.

Then, in Step S607, the CPU accesses a learning value SMO2-MAX-G of a maximum occluded oxygen quantity from the RAM. The learning value SMO2-MAX-G is a maximum occluded oxygen quantity capable of being occluded by the two catalytic converters. After the CPU accesses this value from the RAM, the processing flow advances to Step S608, in which the CPU determines whether the present occluded oxygen quantity SMO2 is larger than the learning value SMO2-MAX-G of the maximum occluded oxygen quantity. If the occluded oxygen quantity SMO2 is the smaller, the answer in Step S608 is negative (NO) and the CPU terminates this routine. On the other hand, if the occluded oxygen quantity SMO2 is the larger, the answer in Step S608 is affirmative (YES), then the CPU sets the learning value SMO2-MAX-G of the maximum occluded oxygen quantity to the occluded oxygen quantity SMO2 and terminates this routine. That is, if the present occluded oxygen quantity exceeds the maximum occluded oxygen quantity of the catalysts, the learning value PGO2-MAX-G of the maximum occluded oxygen quantity to the present occluded oxygen quantity SMO2.

A description will here be given again about the case where it is determined in Step S601 that 1 is not set to the fuel cut flag XFC. In this case, the answer in Step S601 is negative (NO) and the processing flow advances to Step S610, in which 0 is set to the oxygen occluding speed SMO2-FC. That is, when the air-fuel ratio is enriched, a rich gas is fed to the two catalytic converters 16 and 18, so it is assumed that with a rich gas, oxygen is not occluded by the catalytic converters 16 and 18. Then, the processing flow advances to Step S611, in which a check is made to see if 1 is set to the air-fuel ratio enriching request flag XE1RICH.

If it is determined that 1 is set to the air-fuel ratio enriching request flag XE1RICH, the answer in Step S611 is affirmative (YES). Since the oxygen occluded by the upstream-side catalyst 16 is consumed while 1 is set to the air-fuel ratio enriching request flag XE1RICH, the processing flow advances to Step S612, in which a deoccluded oxygen quantity PGO2-1 in the upstream-side catalyst 16, simply deoccluded oxygen quantity PGO2-1 hereinafter, is computed. To be more specific, it is calculated in accordance with the following arithmetic expression:

$$PGO2\text{-}1 = KPGO2\text{-}1 \times (GA \times T)$$

In this expression, since the air-fuel ratio enriching request flag XE1RICH is set to 1, a predetermined value KPGO2-1 is set to a value corresponding to the deoccluded oxygen quantity at an actual air-fuel ratio λ of 0.990 on the premise that the target air-fuel ratio λTG is set to 0.990. Thus, in accordance with the above expression, the deoccluded oxygen quantity PGO2-1 is calculated by multiplying the predetermined value KPGO2-1 by both intake air volume GA detected with the air flow meter 4 and the cycle of arithmetic operation.

In Step S613, a total deoccluded oxygen quantity ΣPGO2-1 in the upstream-side catalyst 16 is computed and the processing flow advances to Step S604. Processings which follow are as described above, so will here be described briefly. In Step S604, 0 is set to the deoccluded oxygen quantity PGO2-2 and the processing flow advances to Step S605. In Step S605, since the target air-fuel ratio λTG is 0.990, both oxygen occluding speed SMO2-FC and deoccluded oxygen quantity PGO2-2 are 0, and a value obtained by adding the deoccluded oxygen quantity PGO2-2 of this time to the SMO2 value of last time is computed as the occluded oxygen quantity SMO2. As to the deoccluded oxygen quantities PGO2-1 and PGO2-2, negative values are set. Therefore, even if these values are added at the time of computing the occluded oxygen quantity SMO2, the deoccluded oxygen quantities PGO2-1 and PGO2-2 are actually subtracted. Processings of steps S607 to S609 are as described previously.

Here again, a description will be given about the processing carried out when 0 is set to the air-fuel ratio enriching request flag XE1RICH and the answer in Step S611 is negative (NO). If the answer in Step S611 is negative (NO), the processing flow advances to Step S615, in which a check is made to see if 1 is set to the air-fuel ratio enriching request flag XE2RICH. If the flag XE2RICH is 0, then in Step S616 there is calculated a deoccluded oxygen quantity PGO2-2 for the downstream-side catalyst 18. More specifically, it is computed in accordance with the following arithmetic expression:

$$PGO2\text{-}2 = KPGO2\text{-}2 \times (GA \times T)$$

In this expression, it is premised that the air-fuel ratio enriching request flag XE2RICH is set to 1, and since the target air-fuel ratio λTG at this time is 0.995, a deoccluded oxygen quantity corresponding to this air-fuel ratio is set for a predetermined value KPGO2-2. The deoccluded oxygen quantity PGO2-2 is computed by multiplying the predetermined value KPGO2-2 by both intake air volume GA and the cycle of arithmetic operation. Then, in Step S605, since both oxygen occluding speed SMO2-FC and deoccluded oxygen quantity PGO2-1 are 0 due to enriching of the air-fuel ratio by the air-fuel ratio enriching request flag XE2RICH, the occluded oxygen quantity SMO2 can be computed by adding the deoccluded oxygen quantity PGO2-2 to the SMO2 value of the previous time. As the deoccluded oxygen quantity PGO2-2, a negative value is stored as is the case with the deoccluded oxygen quantity PGO2-1. Then, the CPU executes the processings of steps S607 to S609 in the manner described above and terminates this routine.

On the other hand, in the case where the air-fuel ratio enriching request flag XE2RICH is set to 0, since the air-fuel ratio control after the return from fuel cut has been completed, the answer in Step S615 is negative and the processing flow advances to Step S617, in which 0 is set to the deoccluded oxygen quantity PGO2-2. In Step S618, 0 is set to both the total deoccluded oxygen quantity ΣPGO2-1 in the upstream-side catalyst 16 and the occluded oxygen quantity SMO2, followed by resetting to complete this routine.

In this embodiment, since the occluded oxygen quantity SMO2 in the two catalytic converters 16 and 18 become 0, the air-fuel ratio enriching request flag XE2RICH is set from 1 to 0 and the air-fuel ratio control after fuel cut is completed. Although in the above description there was used the learning value SMO2-MAX-G of the maximum occluded oxygen quantity in the catalytic converters, the catalytic converters, as generally known, decrease in their maximum occluded oxygen quantity due to deterioration with the lapse of time. In this embodiment, therefore, a processing for updating this learning value is executed.

In updating the learning value, it is premised that the maximum occluded oxygen quantity SMO2-MAX-G is a maximum occluded oxygen quantity in both upstream- and downstream-side catalysts 16, 18 and that the degree of deterioration of the upstream-side catalyst and that of the downstream-side catalyst are correlated with each other. In this embodiment, after the return from fuel cut, the air-fuel ratio enriching request flag XE1RICH is set to 1 and 0.990 is set to the target air-fuel ratio λTG, whereby first the deoccluded oxygen quantity PGO2-1 in the upstream-side catalyst 16 is computed. At this time, that the oxygen occluded by the upstream-side catalyst 16 has been consumed sufficiently is determined when the output of the oxygen sensor 17 has exceeded the predetermined value KOSC. Therefore, the maximum occluded oxygen quantity in the upstream-side catalyst 16 can be substituted by the total deoccluded oxygen quantity ΣSMO2-1 at the target air-fuel ratio λTG of 0.990. The total deoccluded oxygen quantity ΣSMO2-1 was calculated in Step S613 in the flowchart of FIG. 8.

Figure 9:
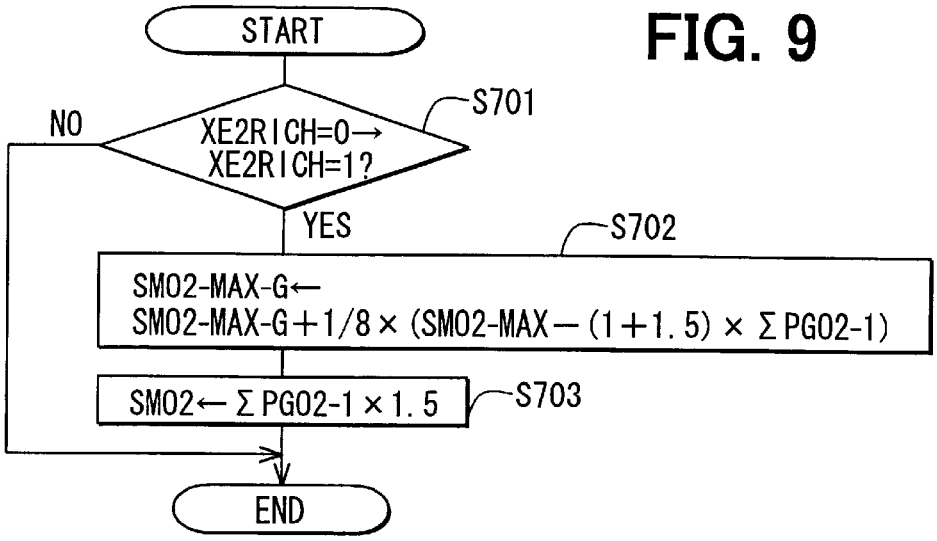
FIG. 9 is a flowchart for updating the amount of oxygen occluded by a downstream-side catalyst according to the first embodiment of the present invention.
Figure 8:
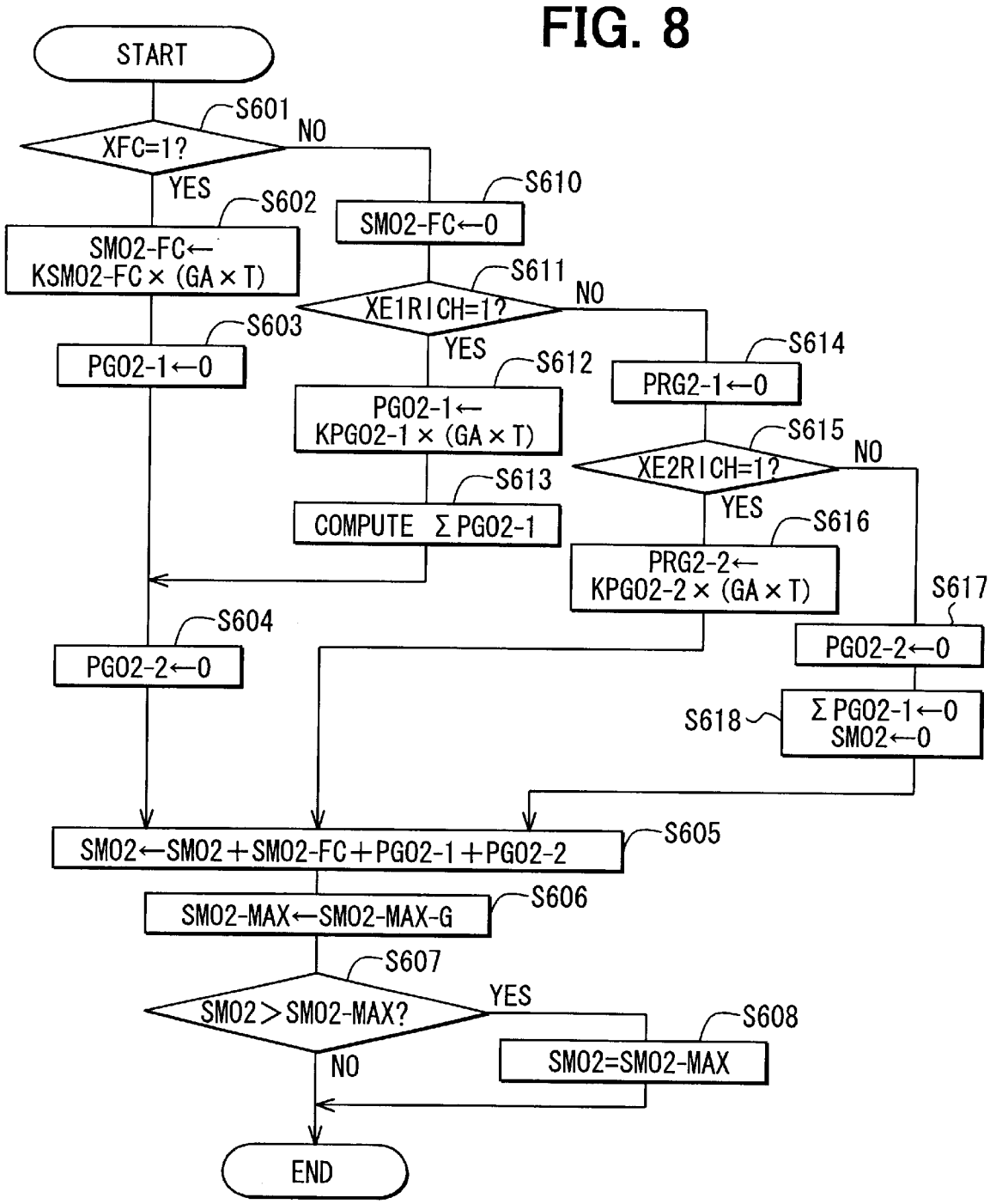
FIG. 8 is a flowchart for computing the amount of oxygen occluded according to the first embodiment of the present invention.

Besides, as noted above, since there is a correlation in the degree of deterioration between the upstream- and downstream-side catalysts 16, 18, there also is a correlation between the maximum occluded oxygen quantity in the upstream-side catalyst 16 and that in the downstream-side catalyst 18. That is, the maximum occluded oxygen quantity in the downstream-side catalyst 18 can be computed on the basis of the total deoccluded oxygen quantity ΣSMO2-1 in the upstream-side catalyst 16. On the basis of such a principle, the learning value SMO2-MAX-G of the maximum occluded oxygen quantity in the catalyst is updated as the sum of the total deoccluded oxygen quantity ΣSMO2-1 in the upstream-side catalyst 16 and the total deoccluded oxygen quantity ΣSMO2-2 in the downstream-side catalyst 18. This point will be described below using an occluded oxygen quantity SMO2 computing routine in an air-fuel ratio enriching request flag switching which is shown in FIG. 9.

First, in Step S701, the CPU determines whether the air-fuel ratio enriching request flag XE1RICH has been switched to the flag XE2RICH. If the switching has not been made, the answer in Step S701 is negative (NO) and the CPU terminates this routine. On the other hand, if it is determined that the switching has been made, the answer in Step S701 is affirmative (YES) and the processing flow advances to Step S702. In Step S702, a learning value SMO2MAX-G of the maximum occluded oxygen quantity in the two catalytic converters 16 and 18 is computed on the basis of the total deoccluded oxygen quantity ΣPGO2-1 in the upstream-side catalyst 16 which has been computed in Step S613 in the flowchart of FIG. 8. More specifically, it is represented by the following arithmetic expression:

$$SMO2\text{-}MAX\text{-}G = SMO2\text{-}MAX\text{-}G + 1/8 \times (SMO2\text{-}MAX - (1+1.5) \times \Sigma PGO2\text{-}1)$$

In the above expression, the learning value of the maximum occluded oxygen quantity in the two upstream- and downstream-side catalysts 16, 18 is computed by adding an offset of the learning value having been subjected to a ⅛ filtering to the learning value SMO2-MAX-G before updating. The offset of the learning value can be determined by a difference between the value of the maximum occluded oxygen quantity SMO2-MAX and a value resulting from the addition of the total deoccluded oxygen quantity ΣPGO2-1 in the upstream-side catalyst 16 and the total deoccluded oxygen quantity ΣPGO2-2 in the downstream-side catalyst 18. Taking into account that there is a correlation between the deterioration of the upstream-side catalyst 16 and that of the downstream-side catalyst 18, the total deoccluded oxygen quantity ΣPGO2-2 can be computed as a function of the total deoccluded oxygen quantity ΣPGO2-1. In this embodiment, ΣPGO2-2 is set equal to 1.5×ΣPGO2-1, taking the catalyst capacity into account.

With such an arithmetic expression, the learning value SMO2-MAX-G of the maximum occluded quantity in the two catalytic converters 16 and 18 can be updated to a value according to catalyst deterioration and matching the actual catalysts. Then, the processing flow advances to Step S703, in which there is executed a computing process for an occluded oxygen quantity SXO2 in the two catalysts 16 and 18 at the time of switching from the air-fuel ratio enriching request flag XE1RICH to XE2RICH. That is, at the time of the switching, it is indicated that the oxygen occluded by the upstream-side catalyst 16 has been consumed, so the occluded oxygen quantity SMO2 in the two catalytic converters 16 and 18 corresponds to the total deoccluded oxygen quantity ΣPGO2-2 in the downstream-side catalyst.

The total deoccluded oxygen quantity ΣPGO2-1 in the upstream-side catalyst 16 has already been computed. Therefore, taking the correlation in the degree of deterioration between the two catalytic converters 16 and 18 into account, the total deoccluded oxygen quantity ΣPGO2-2 in the downstream catalyst 16 can be represented as 1.5× ΣPGO2-1. Thus, at the time of the switching, the occluded oxygen quantity in the catalytic converters 16 and 18 can be corrected on the basis of the total deoccluded oxygen quantity in the upstream-side catalyst 16 and therefore, even if there occurs an offset in the learning value SMO2-MAX-G, it is possible to quickly correct the offset and store an optimal leaning value in the RAM of ECU 21.

The control routine described above will now be explained with reference to a time chart shown in FIG. 10.

Figures 10A, 10B, 10C, 10D, 10E, 10F, 10G, 10H, 10I, 10J, 10K, 10L, 10M, 10N, 10O:
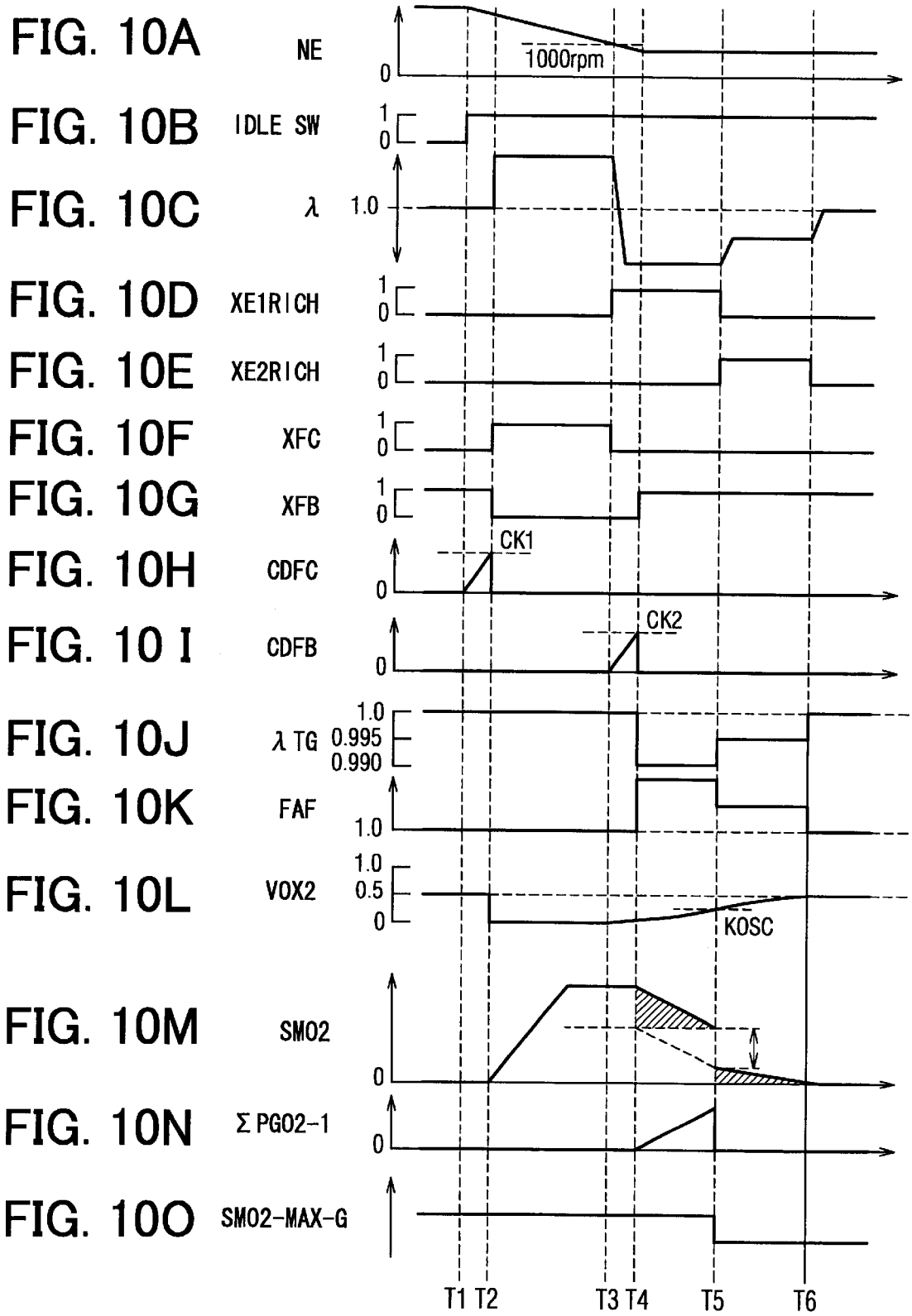
FIG. 10 is a timing chart showing waveforms of signals according to the first embodiment of the present invention.

FIG. 10A shows an engine speed NE which is computed on the basis of the TDC signal outputted from the crank angle sensor 20. If a driver releases the accelerator pedal at time T1 when the engine speed NE exceeds a predetermined rotational speed, e.g., 1400 rpm in this embodiment, an idle switch (SW) shown in FIG. 10B is set to 1. Then, as shown in FIG. 10H, a delay counter CDFC is incremented from time T1. If the count value of the delay counter CDFC exceeds a predetermined value CK1 at time T2, 1 is set to a fuel cut flag XFC shown in FIG. 10F and 0 is set to a feedback flag XFB shown in FIG. 10G, whereby fuel cut is executed. With fuel cut, the air-fuel ratio becomes lean to a large extent because the atmosphere is fed to the exhaust passage 14 as shown in FIG. 10C.

Thus, when fuel cut is started at time T2, the computation of the occluded oxygen quantity SMO2 in the two catalytic converters 16 and 18 is started, as shown in FIG. 10M. Then, when the value of the occluded oxygen quantity SMO2 exceeds the learning value SMO2-MAX-G of the maximum occluded oxygen quantity, the learning value SMO2-MAX-G is set for the occluded oxygen quantity SMO2. At time T3, if the engine speed NE of FIG. 10A becomes lower than 1000 rpm, 0 is set to the fuel cut flag of FIG. 10F to terminate the fuel cut control and the air-fuel control in this embodiment is started. A feedback control start timing lies between time T3 at which the fuel cut control is over and time T4 at which a delay counter CDFB shown in FIG. 10I exceeds a predetermined value CK2.

In the air-fuel ratio control according to this embodiment, first at time T3 1 is set to the air-fuel ratio enriching request flag XE1RICH shown in FIG. 10D, then at time T4 a return is made to the feedback control, and as shown in FIG. 10K, a feedback correction coefficient FAF is computed on the basis of a deviation between the target air-fuel ratio λTG and the actual air-fuel ratio λ. At the same time, the target air-fuel ratio λTG is switched from 1.0 to 0.990, as shown in FIG. 10J. In the air-fuel ratio control at the target air-fuel ratio λTG of 0.990, the oxygen occluded by the upstream-side catalyst 16 is consumed. This consumed oxygen is computed as the total deoccluded oxygen quantity ΣPGO2-1, as shown in FIG. 10N. The occluded oxygen quantity SMO2 in the catalytic converters 16 and 18 is consumed by the total deoccluded oxygen quantity ΣPGO2-1, as shown in FIG. 10M.

Further, as shown in FIG. 10I, when at time T5 the output VOX2 of the oxygen sensor 17 has exceeded the predetermined value KOSC, that is, when a predetermined rich output is provided, the air-fuel ratio control is switched, assuming that the oxygen occluded by the upstream-side catalyst 16 has been consumed. In this air-fuel ratio control, first the air-fuel ratio enriching request flag XE1RICH shown in FIG. 10D is set to 0 and then XE2RICH shown in FIG. 10E is set to 1, whereby the target air-fuel ratio λTG shown in FIG. 10J is switched from 0.990 to 0.995.

The learning value SMO2-MAX-G is updated at the switching timing of time T5 and this point will now be described. In FIG. 10M, the solid line represents an occluded oxygen quantity determined and estimated by an arithmetic operation, while the dotted line represents an actual occluded oxygen quantity. Since in this embodiment the occluded oxygen quantity SMO2 is determined by an arithmetic operation, it is computed beyond the actual occluded oxygen quantity indicated by the dotted line. When the air-fuel ratio control in this embodiment is started at time T4, there is computed the total deoccluded oxygen quantity ΣPGO2-1 in the upstream-side catalyst 16.

This value corresponds to a decrease of the occluded oxygen quantity SMO2.

When the output of the oxygen sensor 17 exceeds the predetermined value KOSC at time T5, it is determined that the oxygen occluded by the upstream-side catalyst 16 has been consumed. At this time, since there is a correlation between the occluded oxygen quantity in the upstream-side catalyst 16 and that in the downstream-side catalyst 18, the deoccluded oxygen quantity PGO2-2 in the downstream-side catalyst 18 can be determined on the basis of the total deoccluded oxygen quantity EPGO2-1 in the upstream-side catalyst 16. Consequently, even if the learning value SMO2-MAX-G is offset as shown in FIG. 100, the learning value is updated at time T5 and the occluded oxygen quantity SMO2 is corrected as in FIG. 10M, so that the oxygen occluded in the two catalytic converters 16 and 18 can be consumed with a high accuracy in accordance with the maximum occluded oxygen quantity.

At time T6, the occluded oxygen quantity SMO2 becomes and a return is made to the normal feedback control/sub-feedback control. In this embodiment, as noted above, the oxygen occluded by the upstream-side catalyst 16 can be consumed quickly by setting the target air-fuel ratio λTG after the return from the fuel cut control at 0.990.

Further, at the time of consuming the oxygen occluded by the downstream-side catalyst 18, the target air-fuel ratio λTG is switched to 0.995, whereby even if the consumption timing of the oxygen occluded by the downstream-side catalyst 18 is offset, it is possible to suppress its influence on the emission because the degree of richness is small. Further, since the updating of the learning value PGO2-MAX-G is performed on the basis of the correlation between the upstream- and downstream-side catalysts 16, 18, it is possible to determine with a high accuracy that the oxygen occluded by the downstream-side catalyst has been consumed.

Although in this embodiment the target air-fuel ratio λTG is switched to 0.995 when the output of the oxygen sensor 17 indicates a predetermined degree of richness, the switching may be done using a first preset period. Likewise, the target air-fuel ratio λTG may be switched to 0.995 on the basis of the value of the occluded oxygen quantity SMO2. Further, in the setting of the target air-fuel ratio λTG, the degree of richness is not limited to 0.990 and 0.995, but for example the target air-fuel ratio λTG may be switched from 0.970 to 0.985 insofar as a change is made in a small degree of richness.

Although the processings after the return from fuel cut have been described in this embodiment, also when the actual air-fuel ratio λ of exhaust gas is leaner than the fourth predetermined value during operation of the engine 1, oxygen is occluded by both upstream- and downstream-side catalytic converters because of a lean air-fuel ratio. Therefore, when the leaner period of the air-fuel ratio than the fourth predetermined value has continued for the second predetermined period and when the air-fuel ratio is set to the fifth air-fuel ratio richer than the fourth predetermined value, the target air-fuel ratio λTG may be set and control may be made as in this embodiment. In this embodiment, moreover, that the oxygen occluded by the upstream-side catalyst 16 has been consumed sufficiently is determined when the output VOX2 of the oxygen sensor 17 has exceeded KOSC as the second predetermined value. But this determination may be done when the occluded oxygen quantity exceeds the third preset value.

In this embodiment, the fuel supply stop means corresponds to the means which stops the supply of fuel to be injected by the injector when 1 is set to the flag XFC in the flowchart of FIG. 3. The first air-fuel ratio detecting means corresponds to the linear A/F sensor 15. The second air-fuel ratio detecting means corresponds to the oxygen sensor 17. The first air-fuel ratio enriching means corresponds to the means which sets the target air-fuel ratio λTG to 0.990 in Step S507 in the fuel injection volume computing routine of FIG. 7 with 1 set to the air-fuel ratio enriching request flag XE1RICH in the flowchart of FIG. 6. The second air-fuel ratio enriching means corresponds to the means which sets the target air-fuel ratio λTG to 0.995 in Step S509 in the fuel injection volume computing routine of FIG. 7 with 1 set to the air-fuel ratio enriching request flag XE1RICH in the flowchart of FIG. 6. The first occluded oxygen quantity estimating means corresponds to the flowcharts of FIGS. 8 and 9. The deoccluded oxygen quantity computing means corresponds to the processings of steps S614 to S616 in FIG. 8. The correcting means corresponds to the flowchart of FIG. 9. The determining means corresponds to the means which determines that a leaner period of the exhaust gas air-fuel ratio than the fourth predetermined value has continued for the second predetermined period. The second occluded oxygen quantity estimating means corresponds to the means which estimates the amount of oxygen occluded by the downstream-side catalyst at that time.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An emission control apparatus for engine, comprising a fuel injection valve for the supply of fuel to the engine, a first air-fuel ratio detecting means for detecting an air-fuel ratio of exhaust gas, an upstream-side catalytic converter for purifying hazardous components contained in the exhaust gas, a second air-fuel ratio detecting means for detecting an air-fuel ratio of the exhaust gas, and a downstream-side catalytic converter for purifying the hazardous components contained in the exhaust gas, the first air-fuel ratio detecting means, the upstream-side catalytic converter, the second air-fuel ratio detecting means, and the downstream-side catalytic converter being disposed in an exhaust passage of the engine successively from an upstream side of the exhaust passage, characterized by further comprising:

a fuel supply stop means for stopping the supply of fuel injected by the fuel injection valve during operation of the engine;

a first occluded oxygen quantity estimating means for estimating a total amount of oxygen occluded by the upstream-side catalyst and the downstream-side catalyst;

a first air-fuel ratio enriching means for enriching the air-fuel ratio of the exhaust gas when a return is made from the state in which the supply of fuel is stopped by the fuel supply stop means; and a second air-fuel ratio enriching means which, upon lapse of a predetermined period after execution of the enriching operation of the first air-fuel ratio enriching means, sets the air-fuel ratio of the exhaust gas to a rich ratio smaller than the degree of richness set by the first air-fuel ratio enriching means, wherein the air-fuel ratio enriching operation of the second air-fuel ratio enriching means is stopped when the total amount of oxygen occluded in the upstream-side catalyst and the downstream-side catalyst, which is estimated by the first occluded oxygen quantity estimating means, has become smaller than a predetermined value.

2. An emission control apparatus for engine according to claim 1, wherein the second air-fuel ratio detecting means is an oxygen sensor formed of a solid zirconia electrolyte, the oxygen sensor having a characteristic such that an output voltage outputted correspondingly to the air-fuel ratio changes abruptly at a predetermined air-fuel ratio, and during the predetermined period, when the air-fuel ratio detected by the oxygen sensor exceeds a second predetermined value, the air-fuel ratio enriching operation of the first air-fuel ratio enriching means is stopped and the air-fuel ratio enriching operation of the second air-fuel ratio enriching means is executed.

3. An emission control apparatus for engine according to claim 1, wherein during the predetermined period, when the occluded oxygen quantity estimated by the first occluded oxygen quantity estimating means is smaller than a third predetermined value, the air-fuel ratio enriching operation of the first air-fuel ratio enriching means is stopped and the air-fuel ratio enriching operation of the second air-fuel ratio enriching means is executed.

4. An emission control apparatus for engine according to claim 1, wherein while the supply of fuel from the fuel injection valve is stopped by the fuel supply stop means, the first occluded oxygen quantity estimating means estimates the amount of oxygen occluded in the upstream-side catalyst and the downstream-side catalyst on the basis of the amount of intake air.

5. An emission control apparatus according to claim 1, wherein while the supply of fuel from the fuel injection valve is stopped by the fuel supply stop means, the first occluded oxygen quantity estimating means estimates the amount of oxygen occluded in the upstream-side catalyst and the downstream-side catalyst on the basis of the fuel supply stop period.

6. An emission control apparatus for engine according to claim 1, further comprising:

a determining means for determining that a leaner state of the exhaust gas air-fuel ratio detected by the first air-fuel ratio detecting means than a fourth predetermined value has continued for a second predetermined period, and wherein the first air-fuel ratio enriching means enriches the exhaust gas air-fuel ratio when it is determined by the determining means that a leaner state of the exhaust gas air-fuel ratio than the fourth predetermined value has continued for the second predetermined period and when the exhaust gas air-fuel ratio has exceeded a fifth predetermined value richer than the fourth predetermined value from the leaner state than the fourth predetermined value, the second air-fuel ratio enriching means, upon lapse of a predetermined period after the execution of the enriching operation of the first air-fuel ratio enriching means, sets the exhaust gas air-fuel ratio to a rich value smaller than the degree of richness set by the first air-fuel ratio enriching means, and the air-fuel ratio enriching operation of the second air-fuel ratio enriching means is stopped when the total amount of oxygen occluded in the upstream-side catalyst and the downstream-side catalyst which is estimated by the occluded oxygen quantity estimating means has become smaller than the first predetermined value.

7. An emission control apparatus for engine according to claim 1, further comprising a second occluded oxygen estimating means for estimating the amount of oxygen occluded by the downstream-side catalyst, and wherein the air-fuel ratio enriching operation of the second air-fuel ratio enriching means is stopped when the amount of oxygen estimated by the second occluded oxygen estimating means has become smaller than the first predetermined value.

8. An emission control apparatus for engine according to claim 7, further comprising a deoccluded oxygen quantity computing means for computing the amount of oxygen which is deoccluded from the upstream-side catalyst by the first air-fuel ratio enriching means, and wherein on the basis of the deoccluded oxygen quantity from the upstream-side catalyst computed by the deoccluded oxygen quantity computing means, the second occluded oxygen quantity estimating means estimates the amount of oxygen occluded by the downstream-side catalyst.

9. An emission control system for engine according to claim 1, wherein the first occluded oxygen quantity estimating means compares the estimated oxygen occluded amount with a stored oxygen occluded amount corresponding to a saturated oxygen occluded amount in the upstream-side catalyst and the downstream-side catalyst, and sets the amount of oxygen occluded by the upstream-side catalyst and the downstream-side catalyst to the stored oxygen occluded amount when the estimated oxygen occluded amount is greater than the stored oxygen occluded amount.

10. An emission control apparatus for engine according to claim 8, wherein the stored oxygen occluded amount is corrected on the basis of the deoccluded oxygen quantity from the upstream-side catalyst computed by the deoccluded oxygen quantity computing means.

* * * * *